US005749272A

United States Patent [19]

Phan

[11] Patent Number: 5,749,272

[45] Date of Patent: May 12, 1998

[54] RATCHET SCREW DRIVER

[76] Inventor: Tan Thanh Phan, 4316 25th Ave., Sac., Calif. 95820

[21] Appl. No.: 636,977

[22] Filed: Apr. 24, 1996

[51] Int. Cl.[6] ..... B25B 13/46

[52] U.S. Cl. ..... 81/62; 192/43.1

[58] Field of Search ..... 81/60–63.2; 192/43.1

[56] References Cited

U.S. PATENT DOCUMENTS

| | | | |
|---|---|---|---|
| 593,157 | 11/1897 | Furbish . | |
| 4,290,328 | 9/1981 | Clark | 81/62 |
| 4,621,718 | 11/1986 | De Carolis | 192/43 |
| 4,696,208 | 9/1987 | Lay | 81/58 |
| 5,063,797 | 11/1991 | Huang | 81/60 |
| 5,379,873 | 1/1995 | Shiao | 192/43 |
| 5,437,212 | 8/1995 | Thompson et al. | 81/63.1 |

*Primary Examiner*—James G. Smith
*Attorney, Agent, or Firm*—Bradley P. Heisler

[57] ABSTRACT

A ratchet screw driver 10 is provided which has a handle 20 secured to a primary shaft 40, which in turn is secured to a ratchet housing 50. The ratchet housing 50 selectively supports a secondary shaft 140 which supports driver tips 170 thereon. A switch 120 provides for selective operation of the ratchet screw driver 10 to operate only in a clockwise direction, only in a counterclockwise direction, or in a neutral position which operates in both clockwise and counterclockwise directions. The switch interacts with the ratchet mechanism in a manner such that toggling of the switch in a clockwise direction configures the ratchet screw driver 10 to then be utilizable in a clockwise direction. Toggling of the switch 120 in a counterclockwise direction causes the ratchet screw driver 10 to then be utilizable in a counterclockwise direction. The ratchet housing 50 includes a left pawl 100 and right pawl 110 supported upon a left shelf 70 and right shelf 80 within the ratchet housing 50. The left pawl 100 and right pawl 110 are actuated by the switch 120 to selectively interfere with teeth 152 on a clutch wheel 150 which is secured to the secondary shaft 140. A shroud 130 overlies the ratchet housing 50 and supports the secondary shaft 140 from translation away from the ratchet housing 50 and primary shaft 40. A cross bar 26 is provided extending laterally from the handle 20 to maximize an amount of torque which can be applied by hand to the ratchet screw driver 10.

19 Claims, 4 Drawing Sheets

RATCHET SCREW DRIVER

FIELD OF THE INVENTION

The following invention relates to ratchet mechanisms for hand tools. More specifically, this invention relates to ratchet mechanisms for hand held screw drivers which cause the screw driver to only transmit torque when rotated in one direction, the direction of torque transmission being reversible by toggling a switch.

BACKGROUND OF THE INVENTION

Bolts, nuts, screws, and other threaded devices have long been in prevalent use as attachment devices for a variety of different applications. Many different tools are provided for attachment and removal of these threaded connectors in an effective manner. Some such tools have been configured with ratchet mechanisms which allow torque transfer to occur in only either a clockwise or a counterclockwise direction, and allow free rotation without torque transfer in the opposite direction. For instance, hand held ratchet screw drivers, such as that taught by Furbish in U.S. Pat. No. 593,157, have been in existence for nearly 100 years to simplify the connection and removal of threaded connectors. The ratchet mechanisms utilized in screw drivers as well as other related torque transmitting tools, have taken on a variety of different configurations over the years. For instance, pawls which are basic to the function of the ratchet mechanisms have been modified to provide secure reliable operation and yet be easily activated and deactivated to adjust the device for counterclockwise or clockwise operation. Also, the switches to be utilized for adjustment of the ratchet mechanism from clockwise operation to counterclockwise have been altered in different ratchet screw driver configurations.

However, even though many attempts have been made to improve on the basic ratchet screw driver, numerous different problems still exist in the configuration of these ratchet screw drivers, such that a need exists for more improvements to this basic tool. Many of the ratchet screw drivers in existence have a switch which slides from a clockwise ("on") position to a counterclockwise ("off") position. The two switch positions are spaced away from each other along a line parallel to an axis of rotation of the tool. Such linear orientation of the switch is not intuitive or related in any way to the direction in which the tool is currently configured to be operated. Hence, a need exists for a ratchet tool which has a switch which has a clockwise (on) position and counterclockwise (off) position which are oriented in a manner with respect to each other that is indicative of current directional status of the tool. Namely, when the switch is translated in a clockwise direction to the clockwise (on) position, the tool is then configured to transmit torque in a clockwise direction and when the switch is translated in a counterclockwise direction to the counterclockwise (off) position, the tool is then configured to transmit torque in a counterclockwise direction. Such an orientation would allow a user to easily select a position for the switch without needing to consciously consider how the tool needs to be set up for appropriate operation. Rather, selection of a switch position and use of the tool would become second nature even to a inexperienced user of the tool.

While some ratchet tool devices known in the prior art do provide such an intuitive switch location, such as the Clark, U.S. Pat. No. 4,290,328, such devices do not have a pawl configuration which is capable of high torque reliable operation. Also, it is desirable that a tool be provided which includes a cross bar on the handle for transmission of additional torque thereto. However, before such additional torque can be applied to such a ratchet hand tool, the ratchet mechanism must be sufficiently sturdy to prevent damage to the ratchet mechanism of the ratchet screw driver when such increased torque is applied to said ratchet mechanism. This invention provides such a high torque handle with a ratchet mechanism which can withstand high torque loads without damage thereto and which has an intuitive switching mechanism for convenient operation.

SUMMARY OF THE INVENTION

This invention provides a ratchet screw driver which can transmit torque in one direction but freely rotates in an opposite direction. The ratchet screw driver includes a handle coupled to a primary shaft, the primary shaft in turn is secured to a ratchet housing. A secondary shaft includes one end which is supported within the ratchet housing and a driver tip on an opposite end. The ratchet housing includes a ratchet mechanism therein which allows the secondary shaft to rotate freely in one direction but causes the secondary shaft to rotate with the primary shaft when the primary shaft is rotated in an opposite direction. The directions in which the secondary shaft is allowed to freely rotate and in which the secondary shaft is caused to rotate with the primary shaft are selectable by toggling a switch on an exterior of the ratchet housing.

The switch can move between a first clockwise (on) position and a second counterclockwise (off) position, which are spaced laterally from each other. The first clockwise position for the switch is spaced in a clockwise direction around the ratchet housing away from the second counterclockwise position. Thus, when the tool is to be used to transmit torque between the primary shaft and the secondary shaft in a clockwise direction, the switch is first toggled in a clockwise direction into the first clockwise position. When threaded connector removal is to occur, the switch is toggled in a counterclockwise direction into the second counterclockwise position, causing the primary shaft and secondary shaft to rotate together in a counterclockwise direction for threaded connector removal, while allowing free rotation of the secondary shaft with respect to the primary shaft when the primary shaft is rotated in a clockwise direction.

The handle includes a cross bar extending perpendicularly from the handle, through which additional torque can be easily applied by a hand of a user to the handle and primary shaft. The ratchet mechanism within the ratchet housing transmits torque between the ratchet housing and the secondary shaft through pawls which are of rigid planar construction, and which experience a compression load when torque is transmitted therethrough to the secondary shaft. The pawls selectively engage and disengage with the secondary shaft, when the switch is toggled, causing the ratchet screw driver to change from clockwise to counterclockwise orientation. The pawls are configured such that they can withstand the compression forces applied thereto even when the torque-maximizing cross bar is used with the handle. The secondary shaft is thus caused to rotate with a high amount of torque, without damaging the ratchet mechanism of the ratchet screw driver.

OBJECTS OF THE INVENTION

Accordingly, it is a primary object of the present invention to provide a ratchet screw driver which has a switch allowing the ratchet screw driver to apply torque in either only a clockwise direction or only a counterclockwise direction by toggling the switch in a corresponding clockwise direction or counterclockwise direction, for intuitive simple use of the ratchet screw driver.

Another object of the present invention is to provide a ratchet screw driver which has a handle through which a high amount of torque can be transmitted, such that threaded connectors requiring a high degree of torque input can be manipulated by the ratchet screw driver.

Another object of the present invention is to provide a ratchet screw driver which has a ratchet mechanism which can withstand a high degree of torque without failure or damage thereto.

Another object of the present invention is to provide a ratchet screw driver which has a ratchet mechanism which can be toggled between a clockwise direction and a counterclockwise direction by toggling of a switch in a clockwise direction or a counterclockwise direction.

Another object of the present invention is to provide a ratchet screw driver which has a shaft which can be fitted with a variety of different driver tips for interfacing with a variety of different threaded connectors and other devices to be rotated.

Another object of the present invention is to provide a ratchet screw driver which is of a design which lends itself to easy assembly and construction from readily available low cost materials.

Another object of the present invention is to provide a ratchet screw driver which has a ratchet mechanism which is of relatively low profile, such that the ratchet screw driver can be used in compact spaces.

Another further object of the present invention is to provide a ratchet screw driver which has a neutral position where it does not rotate freely at all, but can transmit torque in both directions.

Other further objects of this invention will be apparent from a careful reading of the detailed description provided herein and from reading the claims.

DESCRIPTION OF THE DRAWING FIGURES

DESCRIPTION OF THE PREFERRED EMBODIMENT

Figure 1:
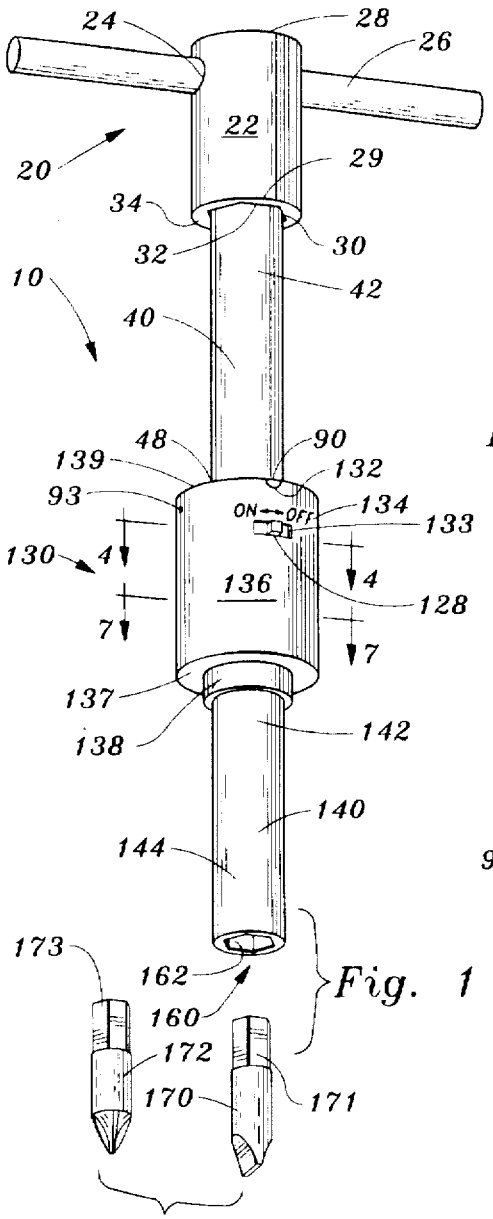
FIG. 1 is a perspective view of the ratchet screw driver of this invention with multiple drive tips shown exploded away from a secondary shaft of the invention.

Referring to the drawings wherein like reference numerals represent like parts throughout, reference numeral 10 (FIGS. 1 and 2) is directed to a ratchet screw driver for attachment and removal of threaded connectors and other threaded devices. The ratchet screw driver 10 is of a "hand-manipulated" variety and has a low profile outer contour for convenient operation in tight spaces. The ratchet screw driver 10 also features replaceable driver tips 170 for use with connectors of various different styles.

Figure 2:
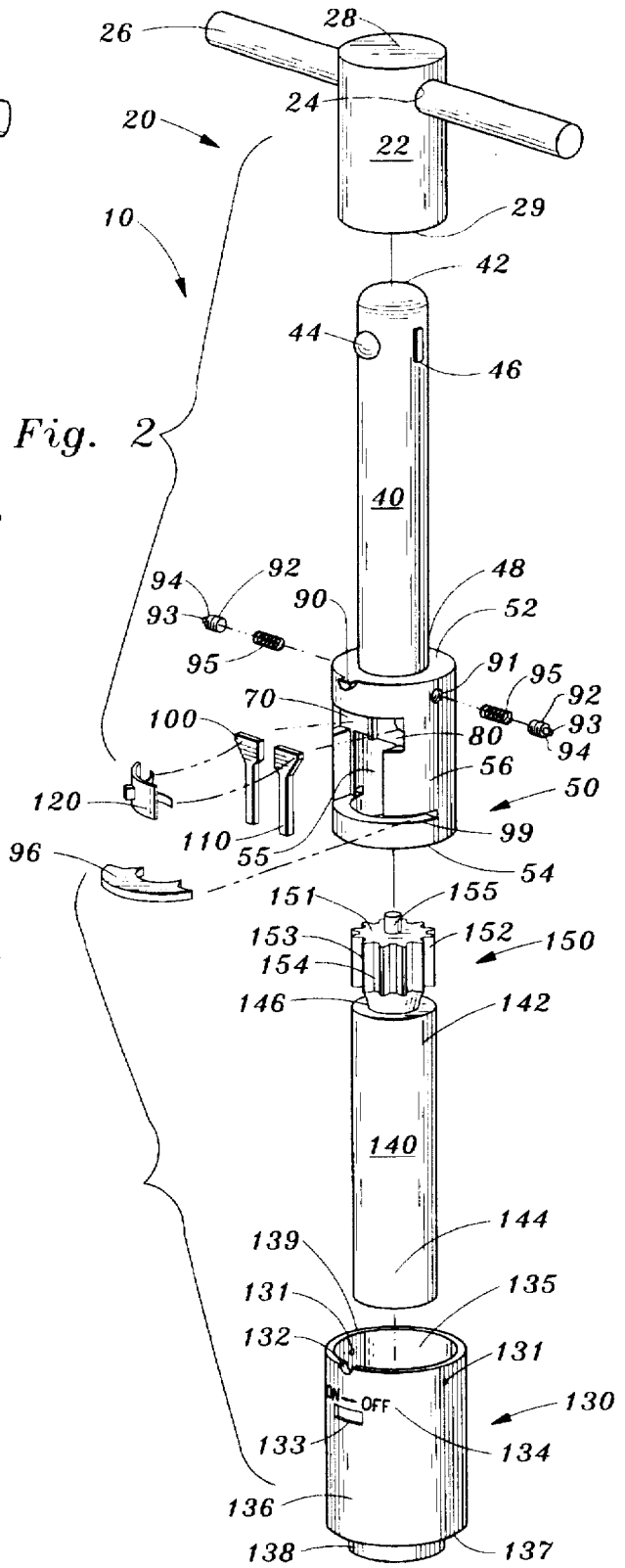
FIG. 2 is an exploded parts view of that which is shown in FIG. 1, revealing the relative orientation individual parts of the invention.
Figure 3:
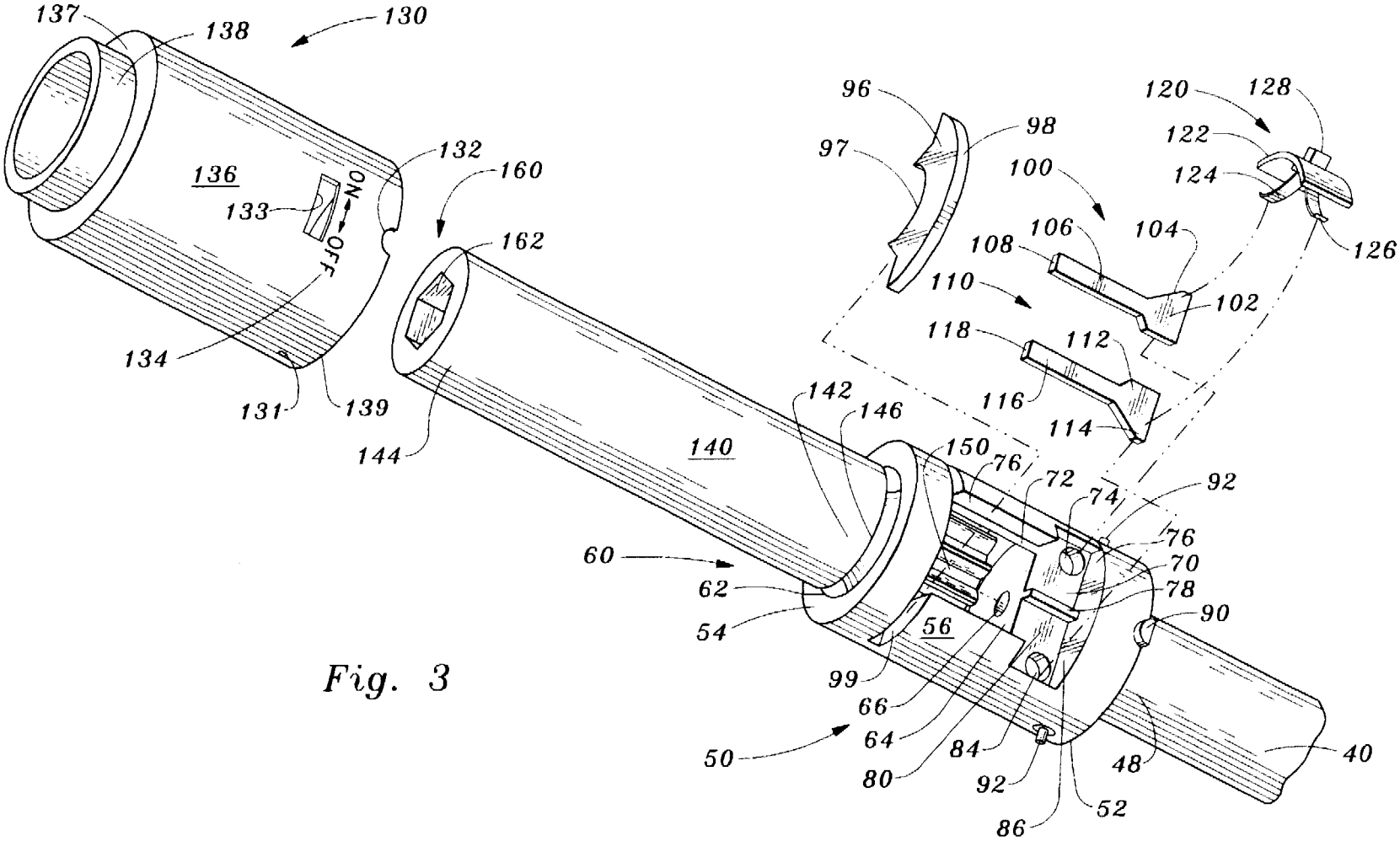
FIG. 3 is an exploded parts view of a portion of that which is shown in FIG. 2 to reveal the orientation of different structures within the ratchet housing of this invention.

In essence, and with particular reference to FIGS. 1 to 3, ratchet screw driver 10 includes a handle 20 which is removably connectable through a receiver 30 to a primary shaft 40. The primary shaft 40 is secured to a ratchet housing 50. The ratchet housing 50 has a bore 60 (FIG. 3) extending up from a secondary end 54 toward a primary end 52. The ratchet housing 50 has an opening 55 (FIG. 2) extending from the bore 50 through to an outer surface 56 of the ratchet housing 50. A left shelf 70 and right shelf 80 are oriented in a shelf plane parallel to a central axis of the primary shaft 40. The left shelf 70 and right shelf 80 are sufficiently close to the central axis of the primary shaft 40, that they are interrupted by the inner surface 68 of the bore 60.

A left pawl 100 and right pawl 110 are sized to rest upon the left shelf 70 and right shelf 80, respectively. A switch 120 is configured to connect to the ratchet housing 50 above the opening 55 and above the left shelf 70 and right shelf 80 in a manner in which the switch 120 is allowed to pivot the left pawl 100 and right pawl 110 when the switch 120 is toggled into different positions. A secondary shaft 140 extends into the bore 60.

The secondary shaft 140 is aligned coaxially with the primary shaft 40 and has a clutch wheel 150 on a ratchet end 142 of the secondary shaft 140, such that the clutch wheel 150 is oriented within the bore 60. The clutch wheel 150 has teeth 152 thereon which extend above the left shelf 70 and right shelf 80 such that the left pawl 100 and right pawl 110 can interfere with rotation of the clutch wheel 150 and secondary shaft 140 when the left pawl 100 and right pawl 110 are appropriately located. The secondary shaft 140 includes a driver support recess 160 on an end thereof opposite the ratchet housing 50. The driver tip 170 can support a variety of different driver tips such as a standard driver tip 170 or a Phillips driver tip 172.

More specifically, and with particular reference to FIGS. 1 and 2, details of the handle 20 are provided. The handle 20 is preferably a substantially cylindrical object formed of a rigid material such as steel and sized to be easily graspable by the hand of a user. The handle 20 includes a body 22 of cylindrical construction which has a tunnel 24 passing entirely therethrough. The tunnel 24 is configured to allow a cross bar 26 to pass through the body 22 and extend from the sides of the body 22. The cross bar 26 has a diameter similar to a diameter of the tunnel 24. The cross bar 26 passes through the body 22 near a top 28 of the body 22. A bottom 29 of the handle 20 includes a receiver 30 therein. The receiver 30 is essentially a recess formed in the body 22 which has side walls which have alternating flat facets 32 and angles 34. Preferably, the receiver 30 has a hexagonal cross section with six facets 32 spaced from each other by six angles 34 between each adjacent facet 32. The receiver 30 is configured to securely, yet removably, attach to the primary shaft 40. The cross bar 26 is oriented on the handle 20 and such a manner that a user can grasp the handle 20 with a hand such that fingers of the user wrap around the cross bar 26 and the cross bar 26 increases an amount of torque which a person can apply from the handle 20 into the primary shaft 40.

With reference now to FIGS. 1 through 3, details of the primary shaft 40 are provided. The primary shaft 40 is a substantially cylindrical elongate solid construct formed from a rigid material, such as steel. The primary shaft 40 has an upper end 42 configured to be removably connectable to the handle 20 through the receiver 30. The primary shaft 40 has two spring balls 44 adjacent the upper end 42 of the primary shaft 40 and which extend outward from the primary shaft 40. The spring balls 44 are configured such that they can be compressed closer to and released further from a central axis of the primary shaft 40. An alignment spline 46 is interposed at a medial location between each spring ball 44. Thus, two alignment splines 46 are oriented on the primary shaft 40 at positions spaced 180° away from each other.

The alignment splines 46 extend outward from the primary shaft 40 a sufficient distance such that a total distance between tips of the two alignments splines 46 are similar to a total distance between two opposite angles 34 within the receiver 30 of the handle 20. Thus, when the upper end 42 of the primary shaft 40 is oriented within the receiver 30, the alignment splines 46 can only allow the primary shaft 40 to fit within the receiver 30 if the alignment splines 46 are aligned with the angles 34 of the receiver 30. Because the receiver 30 has six facets 32, the spring balls 44 are hence oriented adjacent to opposite facets 32 within the receiver 30.

The receiver 30 can include indentations in each of the facets 32, which are sized to receive the spring balls 44 and allow the primary shaft 40 to lock in place within the receiver 30. Thus, the spring balls 44 would be first compressed within the receiver 30 but then extend outward somewhat when the primary shaft 40 is seated with its upper end 42 entirely up within the receiver 30 of the handle 20. In this way, the primary shaft 40 is securely held in place within the receiver 30 and the alignment splines 46 prevent any relative rotation from occurring between the handle 20 and the primary shaft 40. Hence, any torque transmitted to the handle 20 from a hand of a user is transmitted down into the primary shaft 40.

The primary shaft 40 includes a lower end 48 opposite the upper end 42. The lower end 48 is secured to the ratchet housing 50, such as by welding or other fastening operation, so that the ratchet housing 50 is securely and permanently attached to the primary shaft 40. Alternatively, the ratchet housing 50 could be connected to the primary shaft 40 in a manner which allows for detachment of the primary shaft 40 from the ratchet housing 50, allowing replacement of the ratchet housing 50 if needed.

With reference now to FIGS. 2 and 3, details of the ratchet housing 50 are provided. The ratchet housing 50 provides for the selective coupling of the primary shaft 40 to the secondary shaft 140. The ratchet housing 50 has a primary end 52 which is attached to the primary shaft 40 and the secondary end 54 spaced from the primary end 52. Preferably, the ratchet housing 50 is a solid unitary mass of rigid material, such as steel. Preferably, the ratchet housing 50 has an outer surface 56 which is substantially cylindrical. A bore 60 extends up from the secondary end 54 of the ratchet housing 50 toward the primary end 52. The ratchet housing 50 has an opening 55 which extends from the outer surface 56 of the ratchet housing 50 down into the bore 60.

The bore 60 has an opening 62 upon the secondary end 54 of the ratchet housing 50 and an end surface 64 forming a deepest portion of the bore 60 within the ratchet housing 50, most distant from the opening 62 of the bore 60 into the ratchet housing 50. The end surface 64 includes an alignment hole 66 thereon for axial support of the secondary shaft 140 as will be discussed below. The bore 60 is substantially cylindrical and has an inner surface 68 (FIGS. 4 through 9) which defines a radial extent of the bore 60. The inner surface 68 is interrupted by the opening 55.

The opening 55 within the ratchet housing 50 has an irregular contour defined on a bottom portion by the left shelf 70 and the right shelf 80, both oriented within a common shelf plane and bounded on sides by left side walls 76 and right side walls 86 which surround a perimeter of the opening 55. The left shelf 70 and the right shelf 80 are oriented in the shelf plane which is parallel to an axis of rotation of the secondary shaft 140. This shelf plane is located closer to the axis of rotation of the secondary shaft 140 than a major diameter 153 of the teeth 152 extending from the clutch wheel 150 of the secondary shaft 140. Thus, the teeth 152 extend up above the shelf plane and above the left shelf 70 and right shelf 80 and partially through the opening 55.

The left shelf 70 includes a left ledge 72 which extends linearly away from the primary shaft 40 along a region adjacent the clutch wheel 150. The left ledge 72 defines one lateral side of the opening 55 into the bore 60. The left ledge 72 has a substantially constant width between the left side wall 76 and an edge of the left ledge 72 where the left shelf 70 transitions with the inner surface 68 of the bore 60. The left shelf 70 also includes a left depression 74 oriented in a corner of the left shelf 70 closest to the primary shaft 40 and on a leftmost side of the ratchet housing 50. The left depression 74 can take on any of a variety of different configurations, but is preferably formed as a cylindrical depression through the use of a drilling tool.

A medial wall 78 is oriented between the left shelf 70 and the right shelf 80 on a side of the opening 55 adjacent the primary shaft 40. The medial wall 78 is oriented at a mid point between the left shelf 70 and right shelf 80, and defines the boundary between the left shelf 70 and right shelf 80. The medial wall 78 does not extend beyond the end surface 64 of the bore 60, but rather is oriented in a portion of the ratchet housing 50 between the end surface 64 of the bore 60 and the primary end 52 of the ratchet housing 50 adjacent the primary shaft 40. Also, the left shelf 70 has a greater width between the end surface 64 of the bore 60 and the primary end 52 of the ratchet housing 50 than is exhibited by the left shelf 70 along the left ledge 72.

The right shelf 80 is an exact mirror image of the left shelf 72, including a right ledge 82 (FIGS. 7–9), right depression 84 and right side walls 86. The right ledge 82 defines a second, opposite lateral side of the opening 55 into the bore 60.

The ratchet housing 50 includes an alignment post 90, preferably of semicircular construction, extending upward from the outer surface 86 adjacent the primary end 52 of the ratchet housing 50. The alignment post 90 provides for accurate axial location of a shroud 130 which overlies the ratchet housing 50. The outer surface 56 of the ratchet housing 50 includes two holes 91 oriented at locations spaced 180° from each other and spaced slightly from the primary end 52 of the ratchet housing 50. Two retention pins 92 are oriented within the holes 91 with pin springs 95 interposed between bottoms of the holes 91 and the retention pins 92. The retention pins 92 are thus biased to want to pop out of the holes 91. Each retention pin 92 includes a pin tip 93 on a end thereof opposite the pin springs 95 and pin shoulders 94 providing a transition in retention pin 92 diameter adjacent a transition between the retention pins 92 and the pin tips 93. The retention pins 92 are thus configured to secure the shroud 130 in position as will be discussed below.

A slot 99 is oriented in the ratchet housing 50 having a constant width and oriented in a plane perpendicular to a rotational axis of the secondary shaft 140 and the central axis of the ratchet housing 50. The slot 99 extends approximately half way through the ratchet housing 50 such that the slot 99 has an essentially semicircular appearance. A retainer plate 96 is provided having a thickness similar to a thickness of the slot 99. The retainer plate 96 has inner arch 97 and an outer arch 98 such that the retainer 96 exhibits a generally crescent shape. The retainer plate 96 is configured to coact with a groove 146 in the secondary shaft 140 to prevent linear translation of the secondary shaft 140 out of the ratchet housing 50, as will be discussed below.

With particular reference now to FIGS. 2 and 3, details of the left pawl 100 and right pawl 110 are provided. The left pawl 100 is a rigid thin construct of constant thickness and size generally to correspond to a configuration of the left shelf 70 within the ratchet housing 50. The left pawl 100 is formed of highly rigid material, such as a tool steel, such that the left pawl 100 can withstand high compressive loads without being permanently deformed. The left pawl 100 includes a body portion 102 with a shoulder portion 104 extending therefrom and a leg portion 106 extending therefrom down to a tip portion 108. Each of these different portions of the left pawl 100 are oriented within a common plane, such that the left pawl 100 has a constant cross sectional thickness.

When the left pawl 100 is oriented upon the left shelf 70 the body portion 102 is oriented on that portion of the left shelf 70 which is oriented between the end surface 64 of the bore 60 and the primary end 52 of the ratchet housing 50. The shoulder portion 104 of the left pawl 100 is on a side of the body 102 most distant from the medial wall 78 between the left shelf 70 and right shelf 80. The shoulder portion 104 is oriented to overlie the left depression 74. The leg portion 106 extends away from the body 102 in a direction toward the secondary end 54 of the ratchet housing 50 such that the leg portion 106 rests upon the left ledge 72. The tip 108 defines an end of the leg portion 106 most distant from the body portion 102 of the left pawl 100.

The leg portion 106 has a width which is greater than a width of the left ledge 72, such that the left pawl 100 always extends off of the left ledge 72 somewhat and overlies the opening 55 in the ratchet housing 50. Thus, the leg 106 interferes with clutch wheel 150 rotation toward the left pawl 100, when the clutch wheel 150 is rotating towards the left pawl 100 and the left pawl 100 is adjacent the left shelf 70. The left pawl 100 is pivotable in the manner causing the leg 106 to pivot away from the left shelf 70 a sufficient distance to allow the clutch wheel 150 to rotate without interference from the leg 106 of the left pawl 100.

The right pawl 110 has a configuration and attributes which mirror those of the left pawl 100. Hence, the right pawl 110 includes a body portion 112, shoulder portion 114, leg portion 116, and tip portion 118. As with the left pawl 100, the body portion 112 is oriented between the end surface 64 of the bore 60 and the primary end 52 of the ratchet housing 50; the shoulder 114 of the right pawl 110 overlies the right depression 84 of the right shelf 80; the leg portion 116 of the right pawl 110 rests upon the right ledge 82 (FIGS. 7–9) of the right shelf 80; and the right tip portion 118 of the right pawl 110 defines a tip of the leg portion 116 most distant from the body portion 112.

With reference now to FIG. 2 through 6, details of the switch 120 are provided. The switch 120 includes a cylindrical arc 122 having a radius of curvature which generally matches that of the outer surface 56 of the ratchet housing 50. Below the cylindrical arc 122 a left spring arm 124 and right spring arm 126 extend downward in a curving manner. A selector knob 128 extends up from the cylindrical arc 122 in a direction opposite the left spring arm 124 and right spring arm 126.

Figure 4:
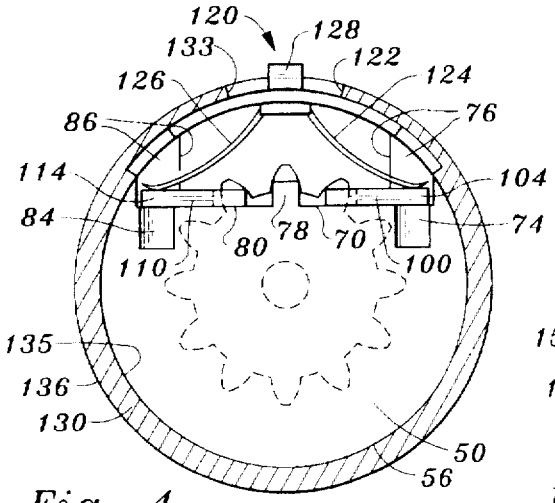
FIG. 4 is a full sectional view taken along line, 4—4 of FIG. 1, with the switch and pawls oriented in a neutral position.
Figure 5:
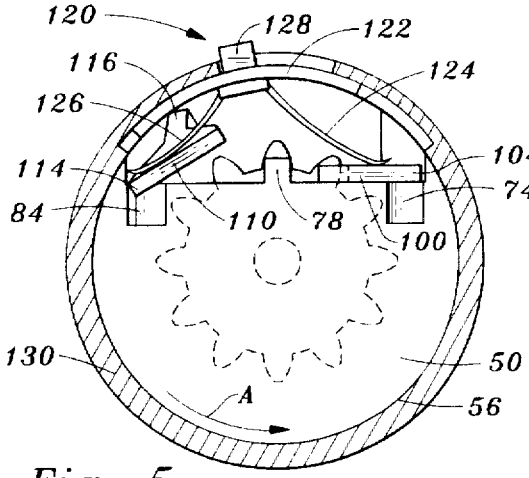
FIG. 5 is a full sectional view similar to that which is shown in FIG. 4 but with pawls and a switch of the invention oriented to allow counterclockwise rotation of the secondary shaft along with the primary shaft for thread connector removal.
Figure 6:
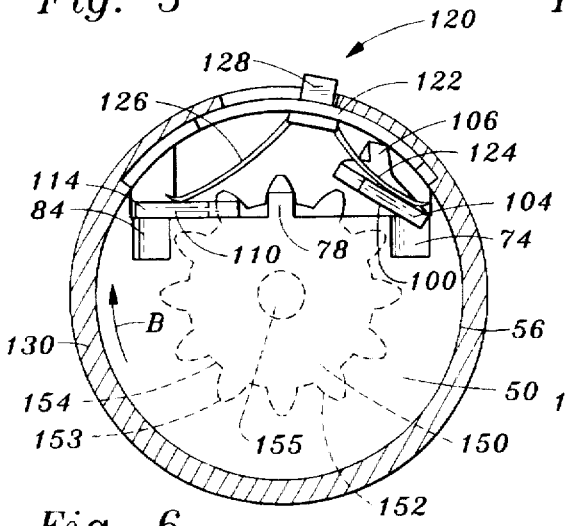
FIG. 6 is a full section view of that which is shown in FIG. 4 but with the switch and pawls oriented to allow clockwise rotation of the secondary shaft along with the primary shaft, for threaded connector installation.

The switch 120 is configured to overlie the portions of the left shelf 70 and right shelf 80 which are between the end surface 64 of the bore 60 and the primary end 52 of the ratchet housing 50. The left spring arm 124 is sufficiently long to come into contact with the body portion 102 of the left pawl 100 (FIGS. 4–6). The right spring arm 126 of the switch 120 if sufficiently long to come into contact with the body portion 112 of the right pawl 110 (FIGS. 4–6). The switch 120 can be toggled through preferably three different positions including a first clockwise (on) position, a second counterclockwise (off) position, and a neutral middle position.

Regardless of the position of the switch 120, the left spring arm 124 preferably remains in contact with the body portion 102 of the left pawl 100 and the right spring arm 126 remains in contact with the body portion 112 of the right pawl 110. Thus, the switch 120 at all times helps support the left pawl 100 and right pawl 110 adjacent the left self 70 and right shelf 80 respectively. However, when the switch 120 is toggled to the first clockwise (on) position, the left spring arm 124 is caused to apply a downward force on the shoulder portion 104 of the left pawl 100 sufficient to cause the left pawl 100 to pivot slightly with the shoulder portion 104 extending down into left depression 74 and the leg portion 106 of the left pawl 100 rising above the left ledge 72 a sufficient distance to provide clearance between the left pawl 100 and the clutch wheel 150.

Similarly, when the switch 120 is toggled to a second counterclockwise (off) position, the right spring arm 126 is caused to apply sufficient force to the shoulder portion 114 of the right pawl 110 to cause the shoulder portion 114 to extend down into the right depression 84, causing the leg portion 116 of the right pawl 110 to be elevated above the right ledge 82 and allowing the clutch wheel 150 to freely rotate past the leg 116.

When the switch 120 is in the middle neutral position, both of the pawls 100, 110 are left in position adjacent the left shelf 70 and right shelf 80, and prevent clutch wheel 150 rotation in either direction, relative to the ratchet housing 50. Alternatively, the neutral middle position can be configured such that in that position both of the pawls 100, 110 are pivoted such that the clutch wheel 150 can freely rotate in either direction.

The cylindrical arc 122 has a sufficient length and width to prevent the switch 120 from falling down into the opening 55. The switch 120 is further supported by the shroud 130 which overlies both the ratchet housing 50 and the switch 120.

The shroud 130 is a hollow generally cylindrical construct which has a diameter slightly greater than a diameter of the outer surface 56 of the ratchet housing 50. Thus, the shroud 130 can slide over the ratchet housing 50. The shroud 130 includes pin holes 131 which are sized to allow the pin tips 93 of the retention pins 92 to snap therethrough, preventing the shroud 130 from rotating once in position about the ratchet housing 50. The shroud 130 also includes an alignment recess 132 positioned to mesh with the alignment post 90 to further prevent rotation of the shroud 130 relative to the ratchet housing 50. The shroud 130 includes a window 133 overlying a region at which the switch 120 is located, and through which the selector knob 128 can extend. This window allows a user to grasp the selector knob 128 on the switch 120 and toggle the switch 120 between its different positions.

The shroud 130 includes print 134 on an outer surface 136 of the shroud 130 adjacent the window 133. The print 134 provides verification to a user as to which direction the switch 120 should to be toggled for the desired operation. Preferably, the print includes the word "on" adjacent the first clockwise position for the switch 120 and the word "off" adjacent the second counterclockwise position for the switch 120. The shroud 130 has an upper edge 139 defining an end of the shroud 130 which is aligned generally adjacent to the primary end 52 of the ratchet housing 50 when the shroud 130 is in place about the ratchet housing 50. Opposite the upper edge 139, the shroud 130 includes a step 137 and collar 138 which prevent the shroud 130 from extending upward beyond the ratchet housing 50. The collar 138 also supplies additional support to the secondary shaft 140.

With reference now to FIGS. 1 through 3, details of the configuration of the secondary shaft 140 and clutch wheel 150 are provided. Preferably, the secondary shaft 140 and clutch wheel 150 are integrally formed together as a single generally cylindrically mass of rigid material, such as metal. The secondary shaft 140 includes a ratchet end 142 which supports the clutch wheel 150 on a driver end 144 opposite the ratchet end 142. A groove 146 is oriented between the clutch wheel 150 and other portions of the secondary shaft 140. The groove 146 defines a region on the secondary shaft 140 which has a slightly decreased diameter with respect to other portions of the secondary shaft 140. The groove 146 is aligned along with the slot 99 in the ratchet housing 50, such that the retainer plate 96 can pass through the ratchet housing 50 and seat down into the groove 146 to prevent displacement of the secondary shaft 140 out of the ratchet housing 50.

The clutch wheel 150 is a generally cylindrical construct with a flat end 151 defining a most distant ratchet end 142 of the secondary shaft 140 and with teeth 152 extending radially from an outer cylindrical surface of the clutch wheel 150. The teeth 152 have a major diameter 153 defining tips of each of the teeth 152 and a minor diameter 154 defining roots of each of the teeth 152. An alignment hub 155 extends from the flat end 151 and is shaped to set within the alignment hole 66 of the bore 60 within the ratchet housing 50. The alignment hub 155 thus supports the clutch wheel 150 and secondary shaft 140 in accurate coaxial alignment with respect to the ratchet housing 50 and primary shaft 40.

The major diameter 153 of the teeth 152 is sufficiently great that the teeth 152 extend above the shelf plane in which the left shelf 70 and right shelf 80 reside, causing the teeth 152 to extend up into the opening 55 of the ratchet housing 50. The teeth 152 thus come into contact with the left pawl 100 and right pawl 110 if the pawls 100, 110 are not pivoted out of position by operation of the switch 120.

The driver end 144 of the secondary shaft 140 includes a driver support recess 160 thereon. The driver support recess 160 extends axially up into the secondary shaft 140 and has sides 162 thereon. A plurality of different driver tips can be provided including a standard driver tip 170 or a Phillips driver tip 172. The standard driver tip 170 has a shank 171 which is configured to securely rest within the driver support recess 160 with the sides 162 of the driver support recess 160 preventing relative rotation between the shank 171 and the driver support recess 160 of the secondary shaft 140. Similarly, the Phillips driver tip 172 includes a Phillips shank 173 which similarly connects within the driver support recess 160. The driver tips 170, 172 are replaceable and exchangeable, along with other possible driver tips, such as those provided as an "Allen" type wrench or those configured to surround a nut; as desired by the user.

Figure 7:
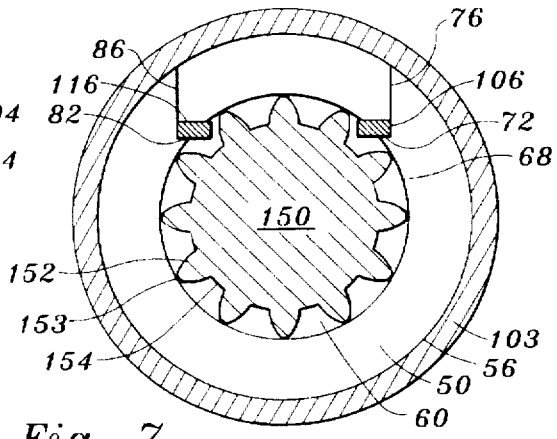
FIG. 7 is a full sectional view taken along lines 7—7 of FIG. 1 and revealing positions of the pawls when the switch is in a neutral position.
Figure 8:
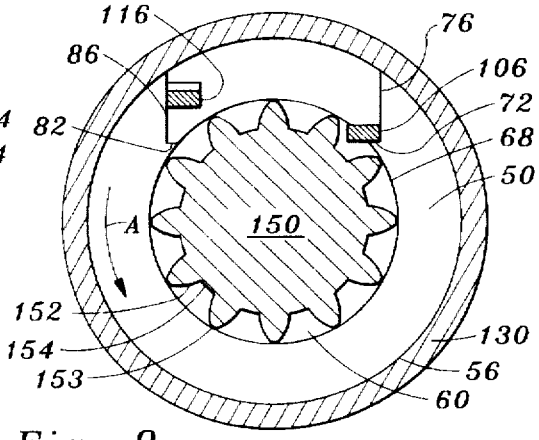
FIG. 8 is a full sectional view similar to that which is shown in FIG. 7 but with the pawls configured as they are in FIG. 5.
Figure 9:
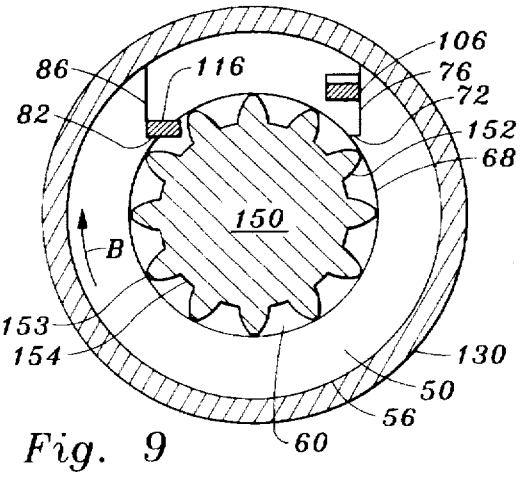
FIG. 9 is a full sectional view of that which is shown in FIG. 7 but with the pawls configured as they are in FIG. 6.
Figure 10:
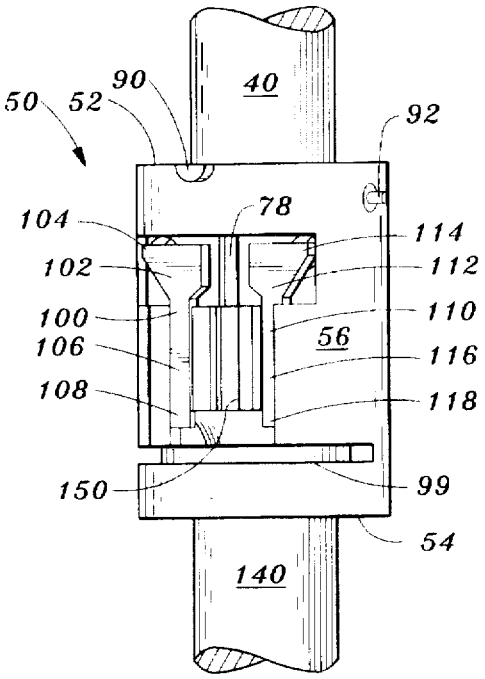
FIG. 10 is a perspective view of a portion of that which is shown in FIG. 1 with the pawls oriented in a neutral position such as that shown in FIGS. 4 and 7.

With reference to FIGS. 4 through 12, details of the operation of the ratchet screw driver 10 are provided in detail. When a user desires for a ratchet screw driver 10 (FIG. 1) to be utilizable not as a ratchet screw driver particularly, but as a replacement for any standard screw driver, the switch 120 is toggled to a neutral position between the on position and the off position. When in this position, the left spring arm 124 and right spring arm 126 of the switch 120 preferably support the left pawl 100 and right pawl 110 adjacent the left shelf 70 and right shelf 80, respectively. As shown in FIGS. 4, 7, and 10, when the switch 120 is in this orientation, the teeth 152 of the clutch wheel 150 are prevented from rotating, relative to the housing 50, in either a clockwise or a counterclockwise direction.

Figure 11:
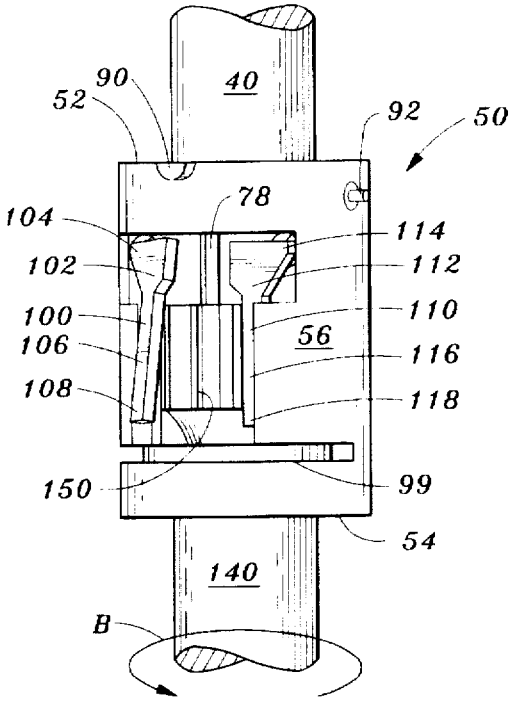
FIG. 11 is a perspective view of that which is shown in FIG. 10 but with the pawls configured in a manner such as that shown in FIGS. 6 and 9.

When the user desires that the ratchet screw driver 10 be usable in a ratchet fashion, such that torque is transmitted from the primary shaft 40 to the secondary 140 in a clockwise direction but not in a counterclockwise direction, the switch 120 is toggled to a first clockwise "on" position (see FIGS. 6, 9 and 11). When in this position, the left spring arm 124 (shown on the right in FIG. 6) causes the shoulder 104 of the left pawl 100 to be pivoted down into the left depression 74 of the left shelf 70 and the tip 108 of the left pawl 100 is caused to be elevated above the left shelf 70. In this configuration, clockwise rotation of the primary shaft 40 and ratchet housing 50, along arrow B (FIGS. 6 and 9) causes the right pawl 110 and the leg portion 116 thereof to be driven against the teeth 152 of the clutch wheel 150 and causes the secondary shaft 140 to rotate in a clockwise direction (also along arrow B) along with the primary shaft 40. However, when the primary shaft 40 is rotated in a counterclockwise direction, opposite that shown with arrow B, the secondary shaft 140 is allowed to rotate freely independent of the primary shaft 40.

Figure 12:
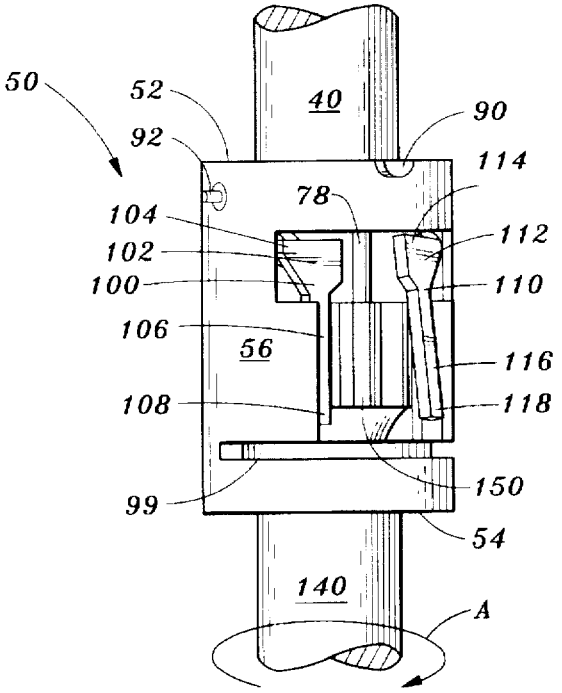
FIG. 12 is a perspective view of that which is shown in FIG. 10 but with the pawls configured in a manner such as that shown in FIGS. 5 and 8.

When a user desires to remove a threaded connector, the switch 120 is toggled to the second counterclockwise "off" position, causing the right spring arm 126 to alter the position of the right pawl 110 such that the pawls 100, 110 are configured as shown in FIGS. 5, 8, and 12. In this orientation, when the primary shaft 40 and attached ratchet housing 50 are rotated counterclockwise, along arrow A, the leg portion 106 of the left pawl 100 causes the teeth 152 of the clutch wheel 150 to rotate, causing the secondary shaft 140 to rotate in a counterclockwise direction (also along arrow A). However, when the primary shaft 40 rotates in a clockwise direction, the secondary shaft 140 is not forced to rotate along with the primary shaft 40.

When the user desires to change a driver tip which is being utilized, the previously used driver tip 170, 172 is removed from the driver support recess 160 and another tip is inserted into the driver support recess 160. A user can supply additional torque to the handle 20 by configuring the cross bar 26 through the handle 20, allowing the user to apply additional torque through the handle 20 to the primary shaft 40. This torque is then transmitted through the ratchet housing 50, through the left pawl 100 or the right pawl 110 and then on to the secondary shaft 140 through the clutch wheel 150. Each of these torque transmitting structures is preferably formed of a high strength steel or other material, such that reliable high torque performance of the ratchet screw driver 10 occurs.

While the above details of the ratchet screw driver 10 are provided to describe a preferred embodiment for the ratchet screw driver 10, various different alterations to the above description are apparent from a review of the drawings and careful reading of the claims herein. For instance, dimensions of the clutch wheel 150 and pawls 100, 110 as well as the configurations of the left shelf 70 and right shelf 80 could be varied somewhat without departing from the scope and fair meaning of the invention claimed herein.

What is claimed is:

1. A ratchet screw driver comprising in combination:

a primary shaft, a ratchet housing secured to said primary shaft, a bore oriented within said ratchet housing, a secondary shaft having a outer diameter less than an inner diameter of said bore, said second shaft having clutch teeth extending radially from a portion of said second shaft, said clutch teeth oriented within said bore of said housing, and a driver tip secured to said secondary shaft and including means to interface with a device which is to be rotated, in a manner causing the device to rotate when said driver tip rotates, said ratchet housing including a shelf oriented in a shelf plane substantially parallel to said secondary shaft, said shelf plane being closer to a central axis of said secondary shaft than said clutch teeth, such that said clutch teeth extend above said shelf plane and into an opening, said ratchet housing including at least two pawls adjacent said shelf, said pawls sized to both rest on said shelf simultaneously with a portion of each said pawl oriented between said clutch teeth of said secondary shaft and said primary shaft.

2. The ratchet screw driver of claim 1 wherein each of said at least two pawls extends over an edge of said shelf a sufficient distance to prevent rotation of said clutch teeth, and said secondary shaft attached thereto, in a direction which brings said clutch teeth towards said pawl, when said pawl is resting on said shelf, said ratchet housing including a switch having means to pivot said pawl about an axis non-parallel to said secondary shaft and off of a portion of said shelf to a position clear of a major diameter of said clutch teeth, to allow rotation of said clutch teeth and said secondary shaft, relative to said pawl, said switch having at least two positions spaced laterally from each other along a line substantially perpendicular to said secondary shaft.

3. The ratchet screw driver of claim 2 wherein at least two of said pawls include a main body portion and a leg portion extending from said main body portion, a first one of said pawls oriented with its main body portion on a side of said ratchet housing closest to said primary shaft and with said leg extending from said main body portion in a direction away from said primary shaft and along a first lateral side of an opening into said bore, and wherein a second of said pawls is oriented with a body portion oriented on a side of said opening closest to said primary shaft and with a leg extending from said body portion in a direction opposite the primary shaft and on a second lateral side of said opening opposite said leg of said first pawl.

4. The ratchet screw driver of claim 3 wherein said switch has a first clockwise position in which said switch includes means to pivot a first one of said pawls clear of said major diameter of said clutch teeth and means to keep the second of said two pawls in position adjacent said shelf, said pawl providing means to prevent rotation of said clutch teeth toward said second pawl, said second pawl oriented to prevent relative rotation between said primary shaft and said secondary shaft when said primary shaft is rotated clockwise, and said switch having a second counterclockwise position in which the orientations of said first pawl and said second pawl are reversed with respect to their positions when said switch is in said first clockwise position, said switch including means to cause said first pawl to prevent relative rotation between said primary shaft and said secondary shaft when said primary shaft is rotated in a counterclockwise direction, whereby when the switch is placed in the clockwise position, the ratchet screw driver can be utilized to drive a device such as a screw in a clockwise direction and when said switch is located in a counterclockwise position, said ratchet screw driver can be utilized to drive a device such as a screw in a counterclockwise direction.

5. The ratchet screw driver of claim 4 wherein said switch is oriented with said first clockwise position and said second counterclockwise position spaced laterally from each other along a line substantially perpendicular to said secondary shaft, said first clockwise position oriented spaced from said second counterclockwise position such that said switch is moved clockwise to travel to said clockwise position, whereby said switch is moved in the direction in which the ratchet screw driver itself is to be used, providing intuitive operation.

6. The ratchet screw driver of claim 5 wherein said shelf surrounding said opening includes a ledge on lateral sides of said opening between said primary shaft and said secondary shaft, each said ledge having a width less than a width of each said leg of said at least two pawls, such that each said leg extends over said edge of said shelf along said ledge, and into a position overlying said opening and interfering with rotation of said clutch teeth.

7. The ratchet screw driver of claim 6 wherein said shelf includes at least two depressions oriented on locations on said shelf overlaid by said main body portions of each of said pawls, said depressions sized to allow a main body portion of a pawl overlying one of said shelf depressions to be pivoted down into said shelf depression somewhat, causing said pawl leg attached to said main body portion to pivot off of said ledge and away from a position interfering with passage of said clutch teeth.

8. The ratchet screw driver of claim 7 wherein said shelf includes a medial wall oriented between said opening and said primary shaft and in an intermediate location between said shelf depressions, said medial wall having sufficient height to prevent one of said pawls on one side of said medial wall from moving in a direction parallel to said shelf plane.

9. The ratchet screw driver of claim 8 wherein said bore includes an inner surface defining an innermost extent of said bore, said inner surface having an alignment hole at an axial center of said bore, said clutch teeth oriented about a periphery of a clutch wheel attached to said secondary shaft, said clutch wheel having an alignment hub extending from an end thereof closest to said primary shaft, said alignment hub having a diameter similar to a diameter of said alignment hole in said inner surface, such that said alignment hole and said alignment hub together allow said clutch wheel to rotate without lateral translation.

10. The ratchet screw driver of claim 9 wherein said primary shaft includes a handle secured to an upper end of said primary shaft, said handle including a cross bar extending away from said handle laterally in two directions spaced approximately 180° opposed from each other and perpendicular to said primary shaft, the width of said handle sized to allow a hand of a user to securely grasp and rotate said handle, causing said primary shaft to rotate, and wherein each said pawl is a substantially planar rigid construct having said leg thereof exhibiting a substantially rectangular cross section, said pawl leg having sufficient width to extend off of said ledge a sufficient distance to prevent rotation of said clutch teeth toward said pawl, when said pawl leg is resting upon said ledge.

11. A high torque ratchet screw driver comprising in combination:

a handle, a primary shaft secured to the handle, a ratchet housing secured to said primary shaft, a bore orientated within said ratchet housing, a secondary shaft having an outer diameter less than an inner diameter of said bore, said secondary shaft having clutch teeth extending radially from a portion of said second shaft, said clutch teeth oriented within said bore of said housing, and a driver tip secured to said secondary shaft and including means to interface with a device which is to be rotated, in a manner causing the device to be rotated when said driver tip rotates, said ratchet housing including an opening extending between an outer surface of said ratchet housing and said bore, said opening including a shelf oriented in a shelf plane substantially parallel to said secondary shaft, said shelf plane being closer to a central axis of said secondary shaft than said clutch teeth, such that said clutch teeth extend above said shelf plane and into said opening, and said ratchet housing including at least two pawls within said opening, said pawls sized to rest on said shelf with a portion thereof extending over an edge of said shelf a sufficient distance to prevent rotation of said clutch teeth, and said secondary shaft attached thereto, in a direction which brings said clutch teeth toward said pawls, when said pawls are resting on said shelf, and means to pivot each of said at least two pawls about an axis non-parallel to said secondary shaft.

12. The high torque ratchet screw driver of claim 11 wherein said handle includes a bar extending substantially perpendicularly from a rotational axis of said handle, such that additional torque can be applied to said handle by the hand of a user, said bar extending away from said handle in two directions spaced 180° from each other.

13. The high torque ratchet screw driver of claim 12 wherein said shelf includes a ledge on lateral sides of said opening between said primary shaft and said secondary shaft, said ledge having a width between a side wall and said opening which is less than a width of a portion of said pawl configured to rest on said ledge, such that when said pawl is oriented upon said ledge and adjacent said side wall, a portion of said pawl extends over said opening, said pawl having a substantially rectangular cross section, said side wall being substantially perpendicular to said shelf plane, said pawl being wedgeable between the side wall and said ledge on two sides of said pawl and said clutch teeth on a side of said pawl opposite said side wall, such that said pawl prevents rotation of said clutch teeth toward said pawl, said pawl formed of a material which has sufficient strength in compression to prevent damage to said pawl, even when high torque loads are applied to said handle through said bar.

14. The high torque ratchet screw driver of claim 13 wherein a switch is provided on said ratchet housing including means to pivot said pawl about an axis non-parallel to said secondary shaft and off of a portion of a said shelf to a position clear of a major diameter of said clutch teeth, to allow rotation of said clutch teeth and said secondary shaft, relative to said pawl, said switch having at least two positions spaced laterally from each other along a line substantially perpendicular to said secondary shaft, said two positions including a first clockwise position and a second counterclockwise position, said first clockwise position being spaced in a clockwise direction away from said second counterclockwise position, said switch configured such that when said switch is in said clockwise position, said switch pivots said pawl in a manner allowing said high torque ratchet screw driver to have said primary shaft and said secondary shaft rotate together in a clockwise direction, but to prevent rotation of said secondary shaft along with said primary shaft, when said primary shaft is rotated in a counterclockwise direction.

15. The high torque ratchet screw driver of claim 14 wherein at least two pawls are provided upon said shelf within said ratchet housing, each said pawl being a substantially planar rigid construct having a body portion and a leg portion, said leg portion having a width greater than a width of said ledge, said body portion of each said pawl oriented on a side of said opening between said opening and said primary shaft, each said leg of each said pawl oriented on an opposite lateral side of said opening, said body portions being adjacent said switch such that said switch can cause said pawls to be selectively pivoted away from said clutch teeth and said opening, by said switch contacting said body portions of said pawls at a location on said shelf between said opening and said primary shaft.

16. The high torque ratchet screw driver of claim 15 wherein said driver tip secured to said secondary shaft is removably secured to said secondary shaft, such that said driver tip can be replaced with another driver tip having a different configuration for rotating different devices, such that changeable driver tips are provided for said high torque ratchet screw driver.

17. A ratchet mechanism for a torque tool, comprising in combination:

a primary shaft, a ratchet housing secured to said primary shaft, a secondary shaft having a ratchet end adjacent said ratchet housing and a driver end opposite said ratchet end, said driver end including means to transmit torque to a device which is to be rotated, said ratchet end of said secondary shaft oriented adjacent to said ratchet housing, means to selectively secure said secondary shaft to said primary shaft through said ratchet housing when said primary shaft is rotated in a first direction, but allowing said secondary shaft to rotate freely with respect to said primary shaft when said primary shaft is rotated in a second opposite direction, and a switch having at least two positions spaced laterally from each other along a line non-parallel with said primary shaft, said switch being slidable between said two positions, said two positions including a first clockwise position and a second counterclockwise position, said first clockwise position corresponding to said switch causing said selective securing means to secure said primary shaft to said secondary shaft when said primary shaft is rotated in a clockwise direction, but allowing said secondary shaft to rotate freely with respect to said primary shaft when said primary shaft is rotated in a counterclockwise direction, said second counterclockwise position of said switch corresponding to said switch causing said selective securing means to secure said primary shaft to said secondary shaft when said primary shaft is rotated in a counterclockwise direction but allowing said secondary shaft to rotate freely when said primary shaft is rotated in a clockwise direction, said first clockwise position of said switch spaced away from said second counterclockwise position of said switch in a clockwise direction, whereby a user wishing to have the primary shaft secured to the secondary shaft for rotation in a clockwise direction would first slide said switch in a clockwise direction to said first clockwise position such that the switch is slid in a direction corresponding to a direction in which the secondary shaft is to be rotated, wherein said means to selectively secure said secondary shaft to said primary shaft includes said secondary shaft having clutch teeth extending radially from said secondary shaft near said ratchet end of said secondary shaft, said ratchet housing having a bore on a side thereof spaced from said primary shaft, said bore having an inner diameter greater than a major diameter of said clutch teeth of said secondary shaft, said clutch teeth of said secondary shaft oriented within said bore, said ratchet housing including a shelf oriented in a shelf plane substantially parallel to said secondary shaft, said shelf plane being closer to a central axis of said secondary shaft than said clutch teeth, such that said clutch teeth extend above said shelf plane and out of said bore, said ratchet housing including at least two pawls within an opening and adjacent said shelf, said pawls sized to rest on said shelf with a portion thereof extending over an edge of said shelf a sufficient distance to prevent rotation of said clutch teeth and said secondary shaft attached thereto, in a direction which brings said clutch teeth towards said pawls, when said pawls are resting on said shelf, said switch including means to pivot said pawls in a direction away from said shelf to a position which is clear from interference with rotation of said clutch teeth extending from said secondary shaft.

18. The ratchet mechanism of claim 18 wherein said shelf includes at least two ledges, each ledge oriented on opposite lateral sides of said opening between said secondary shaft and said primary shaft, said ledge extending substantially parallel to a direction of extension of said clutch teeth, said ledge having a width less than a width of said pawl, at least two said pawls provided oriented upon said shelf with one of said two pawls having a leg resting on one of said ledges and another of said two pawls having a leg resting on the other of said two ledges, said pawls having a sufficient width to prevent secondary shaft and clutch teeth rotation toward one of said pawls when that said pawl is adjacent said shelf, but allowing secondary shaft and clutch teeth rotation away from said pawl when that said pawl is adjacent said shelf and toward said pawl when said pawl is pivoted away from said shelf, said switch configured to pivot one of said pawls away from said shelf when in said first clockwise position and to pivot the other of said pawls away from said shelf when said switch is oriented in said second counterclockwise position.

19. The ratchet mechanism of claim 18 wherein each said pawl is a substantially planar rigid construct and each said pawl is oriented in a plane parallel to said shelf plane, unless said switch is in said first clockwise position or in said second counterclockwise position, said shelf including at least two depressions therein, each said depression oriented beneath a body portion of one of said pawls and providing an area into which said body portion of each said pawl can be depressed, said depression providing a means to cause a leg portion of said pawl to be elevated away from said shelf and clear of said clutch teeth, when said switch pushes down on said body portion of said pawl, positioning said body portion of said pawl at least partially into said depression, said clutch teeth oriented on a clutch wheel forming said ratchet end of said secondary shaft, said clutch wheel spaced from other portions of said secondary shaft by a groove defining a region of lesser diameter than other portions of said secondary shaft, said ratchet housing having a slot therein into which a retainer plate can be positioned, said retainer plate having a shape which extends down from said ratchet housing and into said groove of said secondary shaft, preventing linear translation of said secondary shaft toward or away from said ratchet housing, but allowing free rotation of said secondary shaft, and said ratchet housing surrounded by a shroud having an inner surface with a diameter greater than an outer surface diameter of said ratchet housing, such that said shroud overlies an outer surface of said ratchet housing.

* * * * *